US007434854B2

(12) United States Patent
Fujimatsu et al.

(10) Patent No.: US 7,434,854 B2
(45) Date of Patent: Oct. 14, 2008

(54) VEHICLE DOOR LOCK CONTROL

(75) Inventors: Nobuyoshi Fujimatsu, Nirasaki (JP); Mitsuhiro Watanabe, Kai (JP); Hideaki Nozawa, Kai (JP)

(73) Assignee: Mitsui Mining and Smelting Co. Ltd. (JP)

( * ) Notice: Subject to any disclaimer, the term of this patent is extended or adjusted under 35 U.S.C. 154(b) by 0 days.

(21) Appl. No.: 11/748,283

(22) Filed: May 14, 2007

(65) Prior Publication Data

US 2007/0273160 A1 Nov. 29, 2007

(30) Foreign Application Priority Data

May 17, 2006 (JP) ..... 2006-138168

(51) Int. Cl.
*E05B 3/00* (2006.01)

(52) U.S. Cl. ..... 292/336.3; 292/201

(58) Field of Classification Search ..... 292/216, 292/201, 336.3; 49/280, 360
See application file for complete search history.

(56) References Cited

U.S. PATENT DOCUMENTS 6,125,583 A * 10/2000 Murray et al. ..... 49/291
6,135,513 A * 10/2000 Hamada et al. ..... 292/201
6,276,743 B1 * 8/2001 Jyawook et al. ..... 296/155
6,651,387 B2 * 11/2003 Choi ..... 49/280
6,701,671 B1 * 3/2004 Fukumoto et al. ..... 49/280
6,722,714 B2 * 4/2004 Ooe et al. ..... 292/216

FOREIGN PATENT DOCUMENTS

JP 2001-182403 7/2001

* cited by examiner

*Primary Examiner*—Gary Estremsky
(74) *Attorney, Agent, or Firm*—Ostrolenk, Faber, Gerb & Soffen, LLP

(57) ABSTRACT

In a vehicle door lock control, an operating handle is provided at a door inside or outside a vehicle to enable a door to open and close. The handle is connected to an operating lever. In a locked position, the door cannot be opened by the operating handle, while it can be opened by the operating handle via a release lever in an unlocking position. The release lever pivotally secured on a base plate is connected to a door latch device of the door to allow the door latch device to disengage from a striker of a vehicle body in the unlocking position thereby opening the door by the operating handle. A lock control pin is moved by a knob lever to control the release lever to allow the door to open. The knob lever is operated by a knob manually inside the vehicle or by an actuator electrically.

4 Claims, 9 Drawing Sheets

VEHICLE DOOR LOCK CONTROL

BACKGROUND OF THE INVENTION

The present invention relates to a vehicle door lock control.

In JP2001-182403A, such a vehicle door lock control comprises an outside lever following door-open operation of an outside handle of a slide door; an inside lever following door-opening operation of an inside handle; a release lever connected to a door latch device; an actuator; and a knob lever following operation of the actuator or an opening/closing knob to move between an unlocking position and a locked position.

However, in the vehicle door lock control in the patent, the knob lever is connected to an output lever of the actuator to enable the knob lever to move between the unlocking position and locked position by power of the actuator, thereby increasing the number of parts to make its size larger.

SUMMARY OF THE INVENTION

In view of the disadvantages in the prior art, it is an object of the invention to provide a vehicle door lock control reducing the number of parts to make its size smaller.

BRIEF DESCRIPTION OF THE DRAWINGS

The features and advantages of the invention will become more apparent from the following description with respect to an embodiment as shown in accompanying drawings wherein.

DETAILED DESCRIPTION OF PREFERRED EMBODIMENTS

Figure 1:
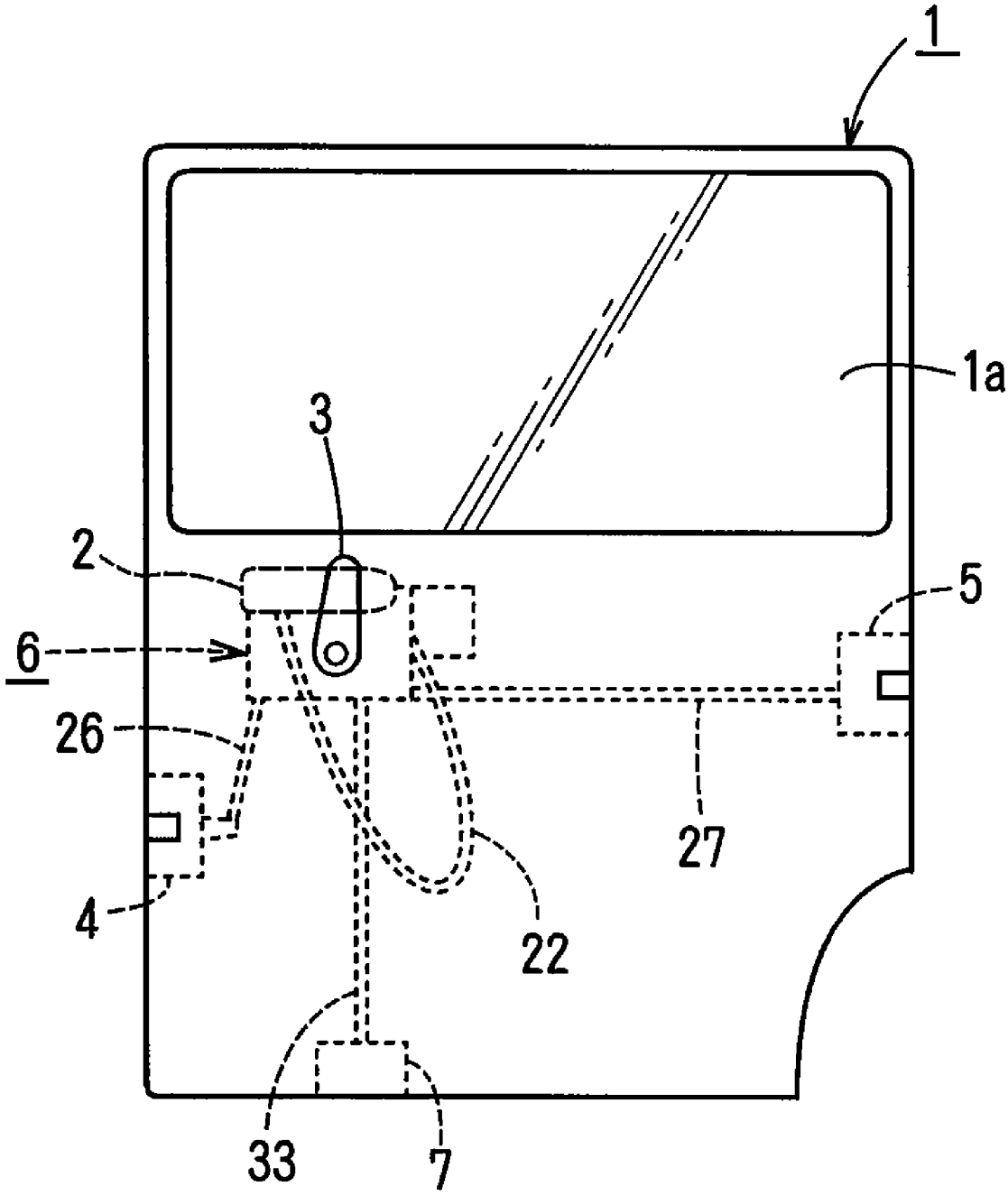
FIG. 1 is a side elevational view of a slide door including a vehicle door lock control according to the present invention.

A slide door 1 is supported at the side of a vehicle body, and opened and closed by moving longitudinally of a vehicle. The door 1 is opened and closed by operating an outside handle 2 outside the vehicle body, while the door 1 is opened and closed by operating an inside handle 3 inside.

At the front and rear ends of the door 1, a front door-latching device 4 and a rear door-latching device 5 are provided by engaging with a front striker (not shown) and a rear striker (not shown) fixed to the vehicle body to hold the door in a closed position. At the lower end of the door 1, a fully-open-latch device 7 holds the door 1 in a fully-open position. In the front part of the door 1, a vehicle door lock control 6 interconnects the operations of the outside handle 2 and the inside handle 3.

The present invention does not require both of the front door-latching device 4 and rear door-latching device 5, but may have at least one of them.

Figure 2:
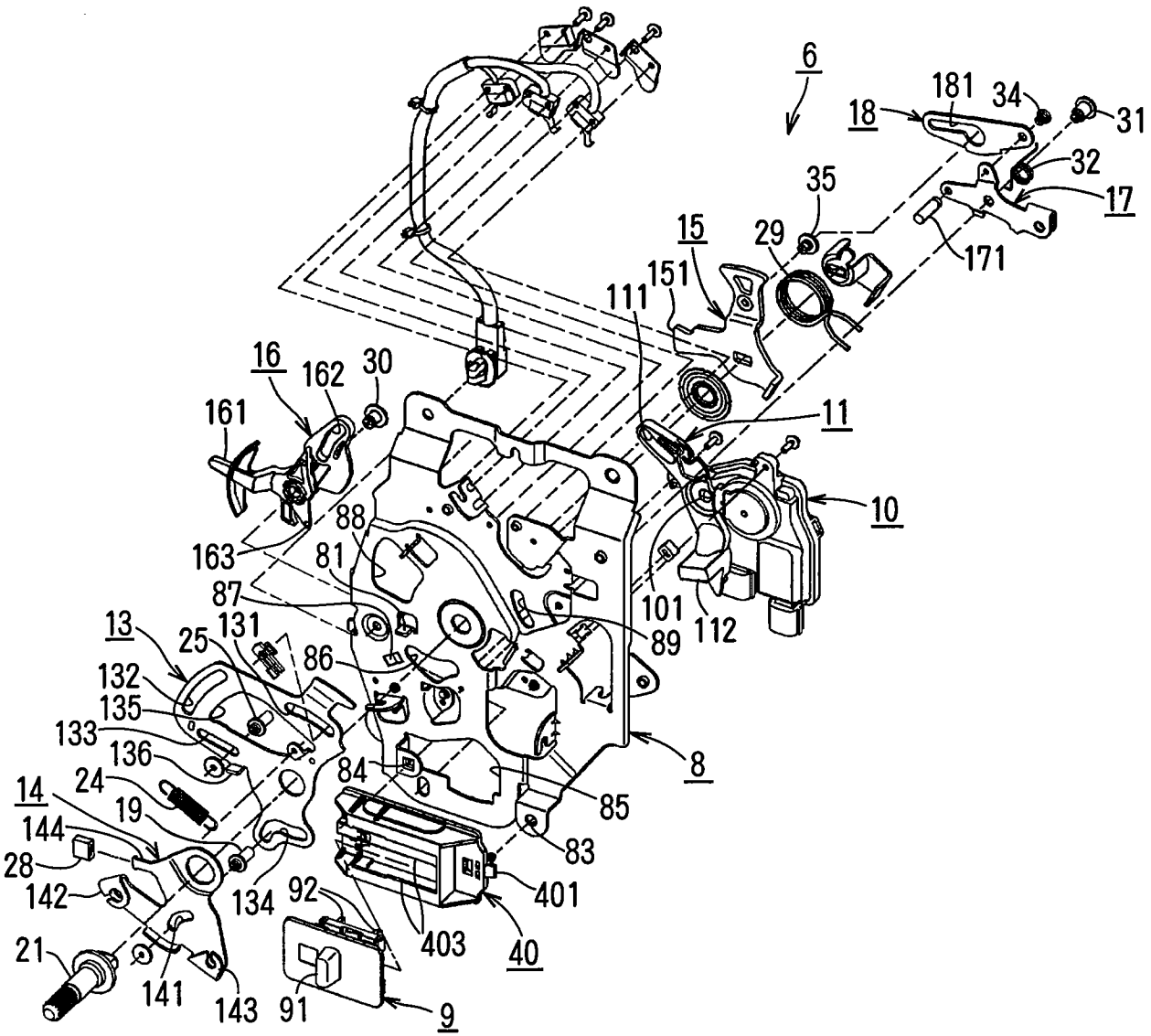
FIG. 2 is an exploded perspective view thereof.

In FIG. 2, the vehicle door lock control 6 comprises a base plate 8 fixed to an inner panel or inside of the vehicle body. The base plate 8 comprises a locking knob 9; a locking actuator 10; a knob lever 11; a releasing actuator 12 (not shown in FIG. 2); an outside lever 13 following opening and closing of the outside handle 2; a release lever 14; an inside lever 15 following opening and closing of the inside handle 3; a child-safety lock lever 16; a first fully-open-latch release lever 17; and a second fully-open-latch release lever 18.

Figure 10:
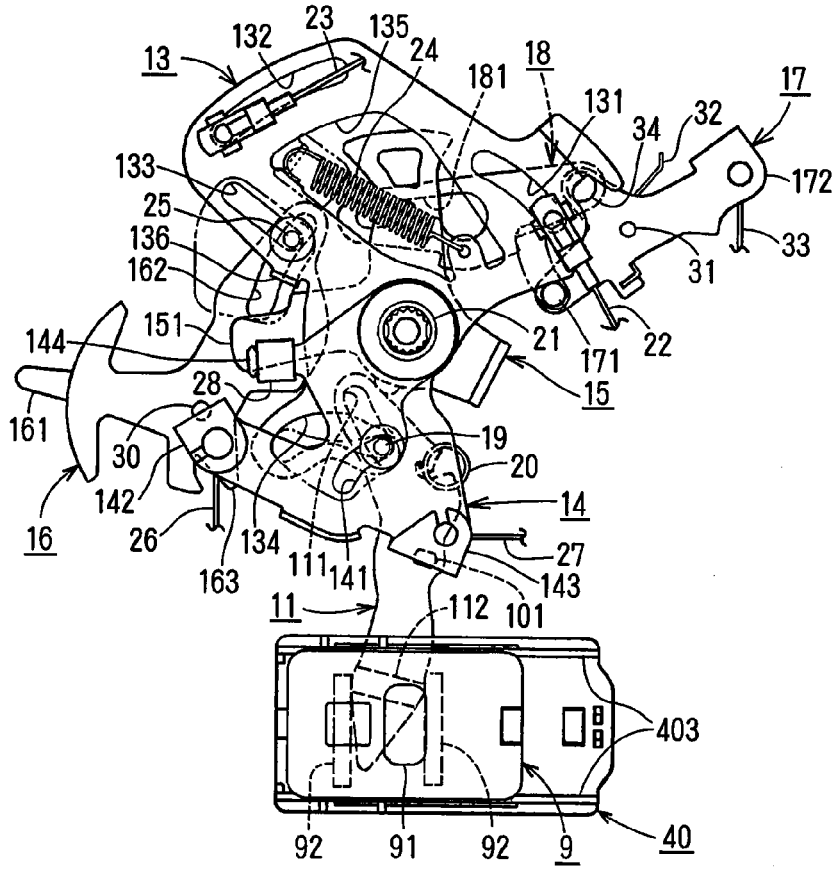
FIG. 10 is a view showing releasing operation when the vehicle door lock control is in the locked state.
Figure 11:
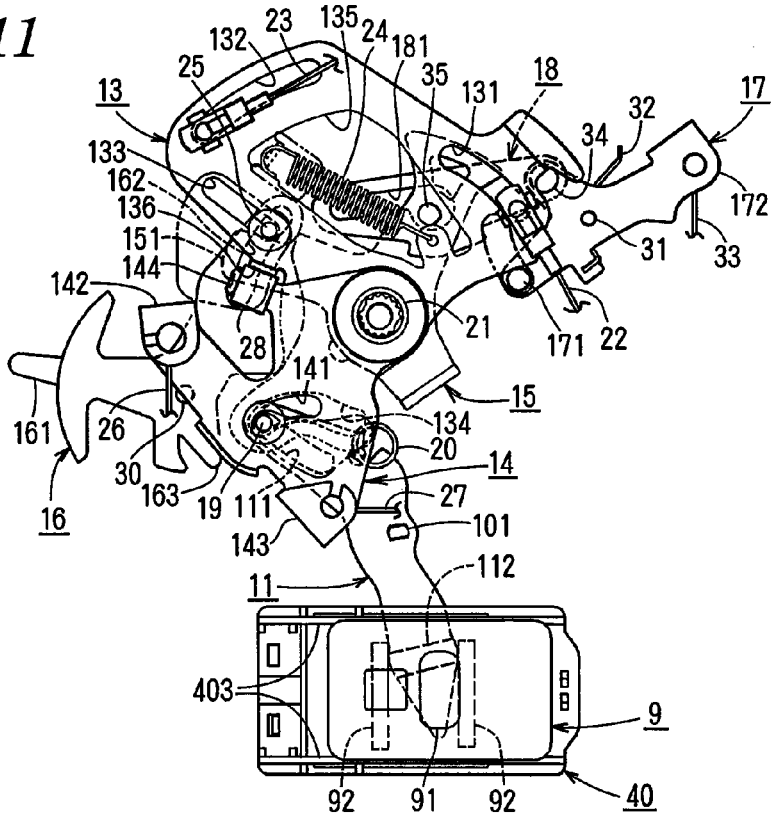
FIG. 11 is a view showing releasing operation when the vehicle door lock control is in the unlocking state.

Inside the vehicle body the locking knob 9 manually switches the vehicle door lock control 6 to an unlocking position or a locked position, and is supported by a guide member 40 fixed to the lower portion of the side of the base plate 8 facing the inside of the vehicle body so that the knob 9 can move longitudinally of the vehicle. A projection 91 exposed inside the vehicle body enables the vehicle door lock control 6 to move between the unlocking position in FIGS. 3, 7, 9 and 11-14 and the locked position in FIGS. 8 and 10.

The unlocking state of the vehicle door lock control 6 means enabling the door 1 to open and close by the outside handle 2 and inside handle 3 when the knob lever 11 and a lock-control pin 19 are in the unlocking position. The locked state means enabling the door 1 not to open by the outside handle 2 or inside handle 3 when the locking knob 9, knob lever 11 and lock-control pin 19 are in the locked position.

The guide member 40 made of synthetic resin is fixed to the base plate 8 by engagement of projections 401,402 with holes 83,84 of the base plate 8.

The locking knob 9 is in sliding engagement with a pair of rails 403 of the guide member 40 to move between the unlocking and locked positions.

The locking actuator 10 shifts the vehicle door lock control 6 to the unlocking or locked state, is mounted on the other side of the base plate 8 facing the outside of the vehicle body and is driven by a wireless switch (not shown) or an operating switch provided in a driver's seat. The base plate 8 is interposed between the locking knob 9 and locking actuator 10.

The knob lever 11 is bent and fixed in the middle to an output shaft 101 of the locking actuator 10 at the other side of the base plate 8. The output shaft 101 makes rotation of the motor l0 slower and output it. A protrusion 112 is provided on the lower part of the knob lever 11 and an elongate hole 111 is formed on the upper part.

The protrusion 112 of the knob lever 11 extends through a first opening 85, projects from the base plate 8 and puts between the projections 92 and 92 of the locking knob 9. Therefore, by operating the locking knob 9 manually and the locking actuator 10 electrically, the knob lever 11 turns to the unlocking position in FIGS. 3, 7, 9 and 11-14 and to the locked position in FIGS. 8 and 10 to which the knob lever 11 turns in a clockwise direction from the unlocking position, and is held in each of the positions by the spring 20.

As mentioned above, the protrusion 112 of the knob lever 11 is put directly between the projections 92 and 92 of the locking knob 9, thereby joining the knob lever 11 to the locking knob 9 directly without any other members. The knob lever 11 is pivotally secured to the output shaft 101 of the locking actuator 10 thereby positioning the knob lever 11 on the other side of the base plate 8 without another pivot.

Furthermore, the knob lever 11 is bent and the base plate 8 is interposed between the locking knob 9 and locking actuator 10, thereby converting rotation of the knob lever 11 to back-and-forth motion of the knob 9.

The lock control pin 19 slidably engages in the elongate hole 111 of the knob lever 11. The elongate hole 111 is formed like an arc around an operating shaft 21 when the knob lever 11 is in the unlocking position.

The lock control pin 19 extends through a second opening 86 of the base plate 8. The end of the pin 19 projecting from the other side of the base plate 8 slidably engages in the elongate hole 111 of the knob lever 11, and the end of the pin 19 projecting from the one side of the base plate 8 slidably engages in control holes 134,141 of the outside lever 13 and release lever 14.

Figure 4:
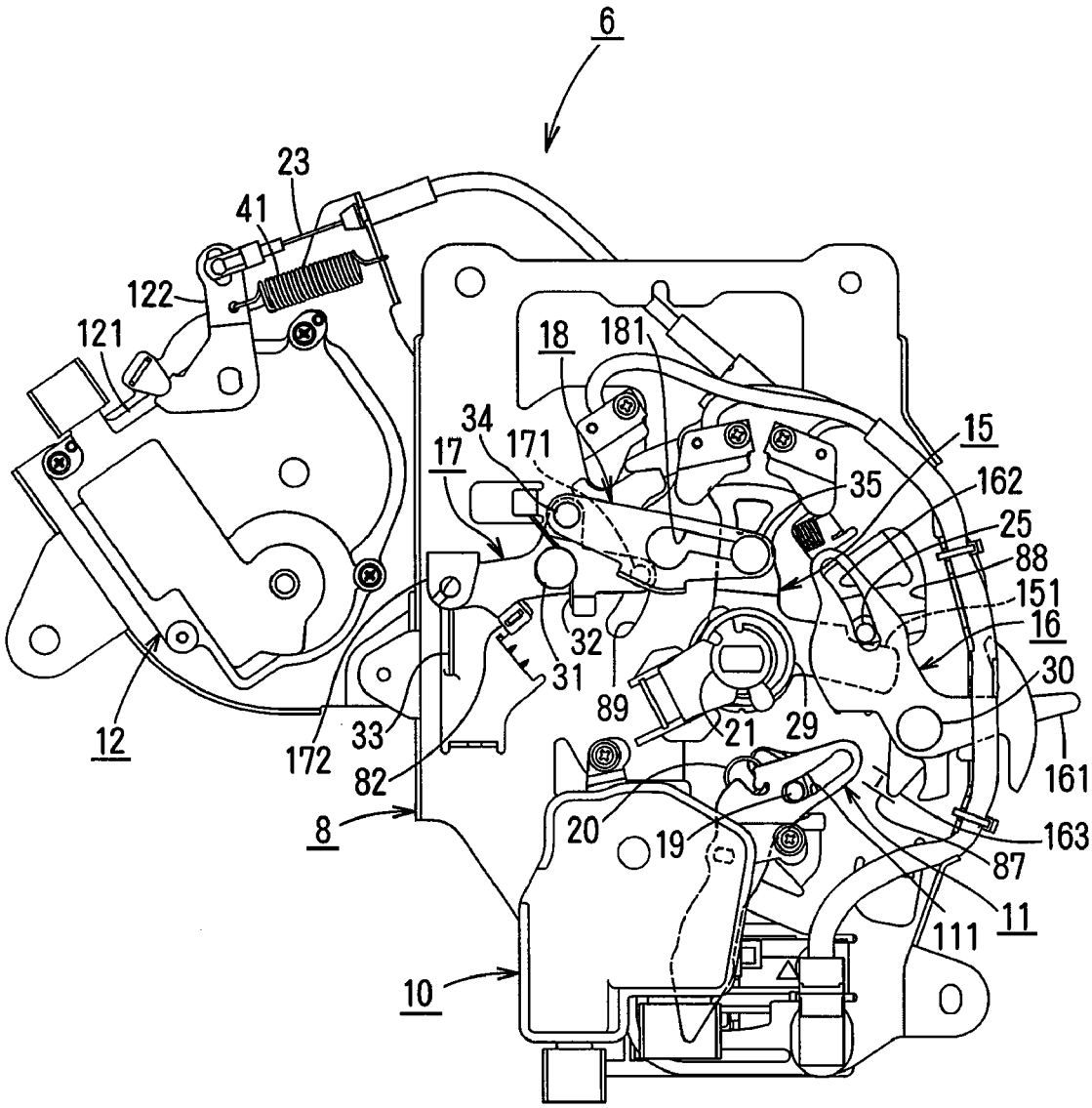
FIG. 4 is a side elevational view seen from the outside of the vehicle.
Figure 5:
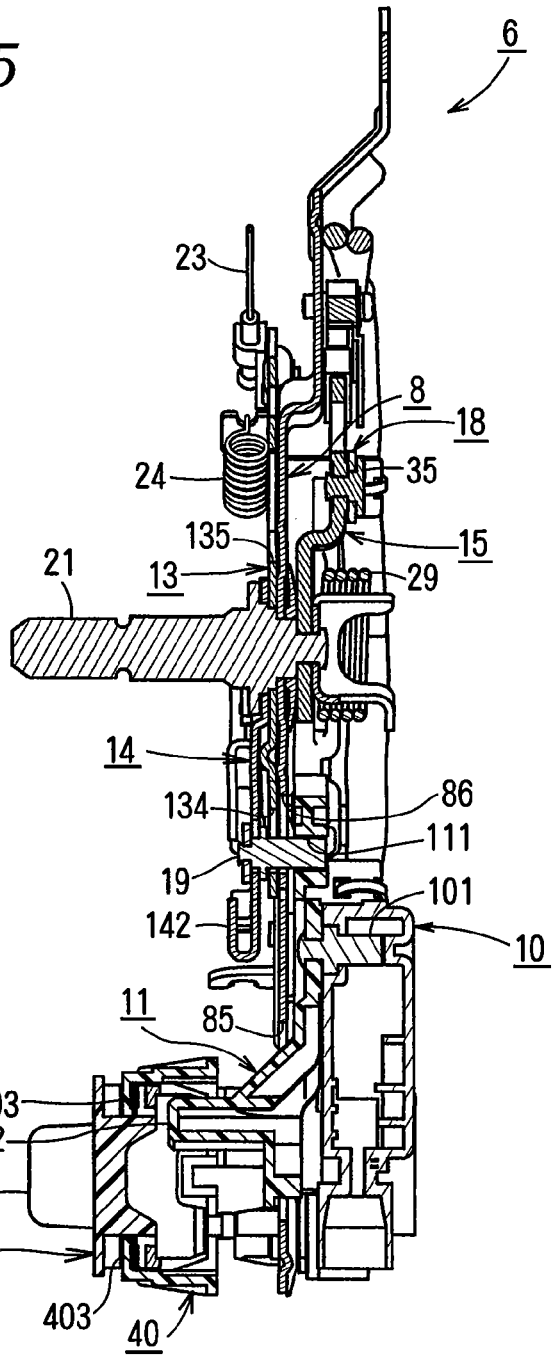
FIG. 5 is a vertical sectional view taken along the line V-V in FIG. 3.
Figure 6:
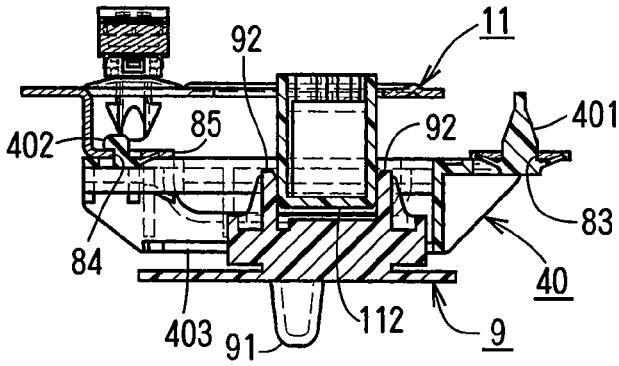
FIG. 6 is a horizontal sectional view taken along the line VI-VI in FIG. 3.

A releasing actuator 12 releases the front door-latching device 4, rear door-latching device 5 and fully-open-latch device 7 and is mounted to the rear part of the base plate 8. By the releasing operation of the wireless switch (not shown) and operating switch in the driver's seat, an output lever 122 pivotally secured to a housing 121 having a motor and reduction gears moves from a stand-by position in FIG. 4 in an anticlockwise direction against the spring 41.

The outside lever 13 is pivotally secured to the middle of the one side of the base plate 8 on the operating shaft 21 extending transversely of the vehicle body and connected to the outside handle 2 and output lever 122 of the releasing actuator 12 via a first cable 22 and a second cable 23. Accordingly, by door-opening of the outside handle 2 or driving the releasing actuator 12, the outside lever 13 rotates in a releasing direction or a clockwise direction in FIG. 3 from the standby position in FIGS. 3, 7, 8 and 12-14 against force of the spring 24 allowing releasing toward a release position in FIGS. 9, 10 and 11.

Within the door 1, the first cable 22 which transmits motion of the outside handle 2 to the outside lever 13 turns around the lower end of a windowpane 1*a* which lowers open. The outside handle 2 in this embodiment opens and closes in the same direction to allow the outside lever 13 to make releasing to open and close the door in the same direction.

A first connecting portion 131 at the upper part of the outside lever 13 slidably engages with the end of the first cable 22. In front of the first connecting portion 131, a second connecting portion 132 slidably engages with the end of the second cable 23 for transmitting force of the releasing actuator 12. Under the second connecting portion 132, an elongate hole 133 slidably engages with a child-safety lock control pin 25. The first and second connecting portions 131,312 comprise arcuate holes around the operating shaft 21.

Under the outside lever 13, the lock control pin 19 slidably engages in a control hole 134 like an inverted L. The control hole 134 is positioned to coincide with the elongate hole 11 of the knob lever 11 via the base plate 8.

The spring 24 for forcing the outside lever 13 towards the standby position comprises a tension spring which engages at one end with the base plate 8 and at the other end with the outside lever 13 and is placed in an opening 135 of the outside lever 13. Thus, even when the outside lever 13 moves from the standby position to the operating position, the spring 24 does not overlap over the outside lever 13 in the transverse direction or axial direction of the operating shaft 21 thereby making the vehicle door lock control 6 thinner.

The release lever 14 is pivotally secured to one side of the base plate 8 with the operating shaft 21. The lower part of the release lever 14 has a control hole 141 which is overlapped over the control hole 134 and engages with the lock control pin 19. The outside lever 13 and release lever 14 are pivotally secured on the operating shaft 21 to rotate separately.

The lock control pin 19 which follows the knob lever 11 moves in the control hole 134 of the outside lever 13 and in the control hole 141 of the release lever 14. When the knob lever 11 is in the unlocking positions the pin 19 is held in the unlocking position at the end of the control hole 134 of the outside lever 13 in FIGS. 3, 7, 9 and 11-14. When the knob lever 11 is in the locked position, the pin 19 is held in the locked position in the middle of the control hole 134 in FIGS. 8 and 10.

When the lock control pin 19 is in the unlocking position, releasing of the outside lever 13 can be transmitted to the release lever 14. Describing it in detail, the outside lever 13 moves from the standby position in FIG. 7 to FIG. 9, so that the lock control pin 19 engages on the end of the control hole 134 of the outside lever 13 and moves from the front end to the rear end of the elongate hole 111 of the knob lever 11. Thus, the lock control pin 19 engages in the control hole 141 of the release lever 14, thereby moving the release lever 14 from the standby position in FIGS. 3, 7, 8, 10 and 12-14 to the release position in FIGS. 9 and 11.

However, when the lock control pin 19 is in the locked position, even if the outside lever 13 is moved, the lock control pin 19 moves in the control hole 134 of the outside lever 13, so that releasing of the outside lever 13 is not transmitted to the release lever 14.

A third connecting portion 142 and a fourth connecting portion 143 at the lower part of the release lever 14 are connected to the front door-latching device 4 and the rear door-latching device 5 respectively via a third cable 26 and a fourth cable 27.

When releasing is made by the release lever 14, it is transmitted to the front door-latching device 4 and the rear door-latching device 5 via the third cable 26 and the fourth cable 27.

Transmission of releasing to the front door-latching device 4 and the rear door-latching device 5 allows them to disengage from the strikers respectively enabling the door 1 to open.

The first connecting portion 131 and the second connecting portion 132 of the outside lever 13 are provided outside an operating area of the release lever 14 not to overlap on the release lever 14 transversely even when the outside lever 13 moves within an operating range between the standby position and the release position.

The third connecting portion 142 and the fourth connecting portion 143 of the release lever 14 are provided outside an operating area of the outside lever 13 not to overlap on the outside lever 13 transversely even when the outside lever 13 moves in an operating range. Accordingly, all the connecting portions 131, 132, 142, 143 can be placed closer to the one side of the base plate 8 thereby making the vehicle door lock control 6 thinner.

Figure 3:
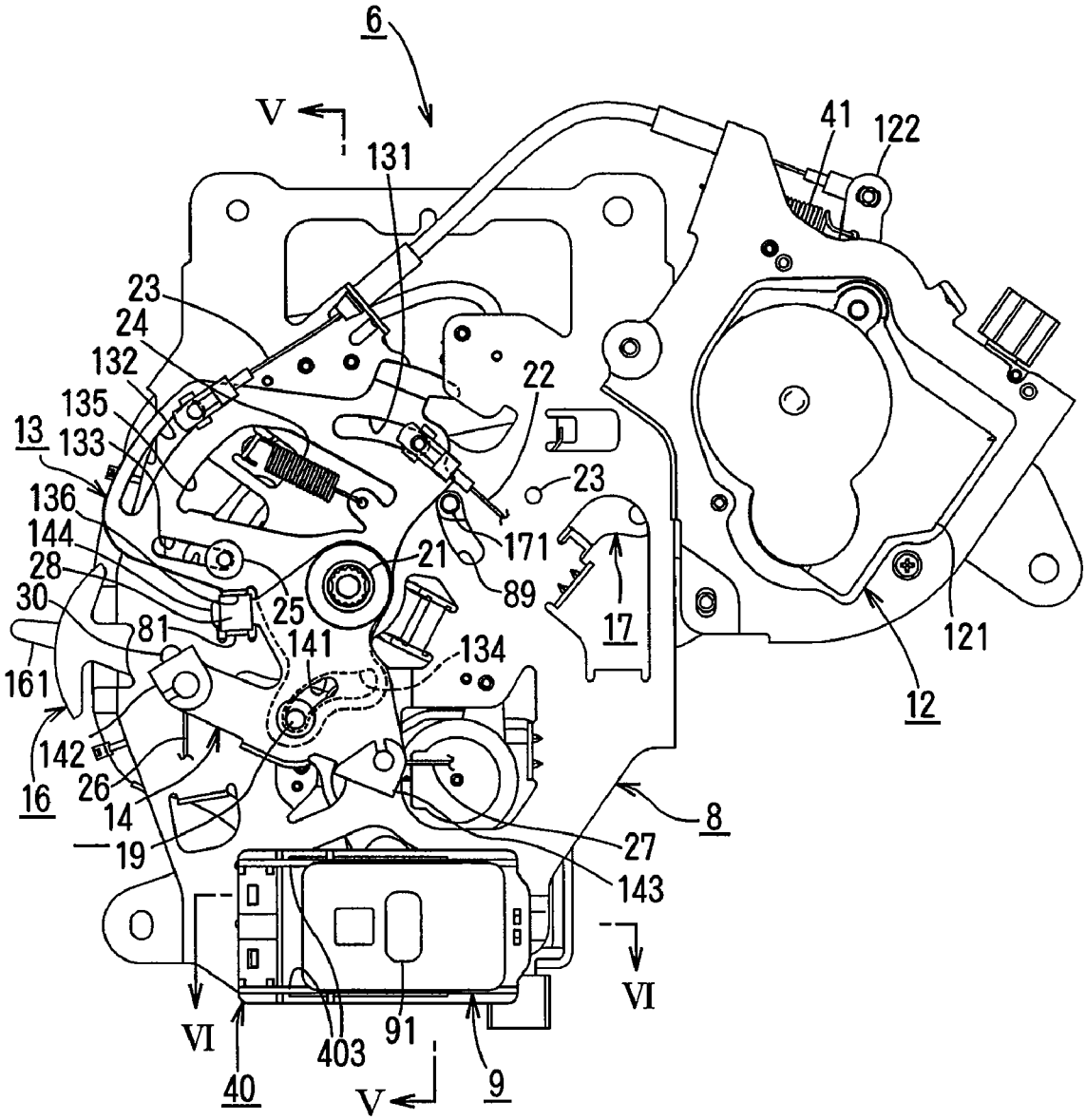
FIG. 3 is a side elevational view seen from the inside of a vehicle.

In FIG. 3, when the release lever 14 stops in the standby position, a buffer member 28 which comprises elastic rubber is provided in an arm member 144 of the release lever 14 and contacts a first stopper 81 of the base plate 8. When the outside lever 13 stops in the standby position, a bent member 136 of the outside lever 13 contacts the first stopper 81 via the buffer member 28. Accordingly, the spring 24 for forcing the outside lever 13 towards the standby position allows both the outside lever 13 and the release lever 14 to be held in the standby position without loosening. Noise can be reduced when the outside lever 13 and the release lever 14 returns to the standby position.

The inside lever 15 is pivotally secured to the other side of the base plate 8 to rotate together with the operating shaft 21 and can turn against the force of the spring 29 from a neutral position in FIGS. 3, 7-10 and 13 in a direction for opening the door or in a clockwise direction in FIG. 3 and in a direction for closing the door or in an anticlockwise direction in FIG. 3. The inside handle 3 is mounted to the end of the operating shaft 21.

The knob lever 11 is placed on the other side of the base plate 8 not to overlap on the inside lever 15 transversely thereby reducing thickness of the vehicle door lock control 6.

The child-safety lock lever 16 is pivotally secured to the front part of the other side of the base plate 8 with a pivot 30 extending transversely. The child-safety lock lever 16 can move from the unlocking position in FIGS. 3 and 7-12 to the locked position in FIGS. 13 and 14 and vice versa by operating an operating portion 161 projecting from the front end of the door 1.

In FIG. 2, an elastic arm 163 extends downward of the child-safety lock lever 16 and elastically engages with a projection 87 on the other side of the base plate 8 thereby holding the child-safety lock lever 16 in the unlocking and locked positions.

The child-safety lock control pin 25 which slidably engages in the elongate hole 133 of the outside lever 13 extends through a third opening 88 of the base plate 8 and slidably engages in an elongate hole 162 of the child-safety lock lever 16.

When the child-safety lock lever 16 moves to the unlocking position, the child-safety lock control pin 25 moves in the elongate hole 133 of the outside lever 13 to a position in which the pin 25 can engage with an arm 151 of the inside lever 15, so that the pin 25 is held. Thus, when the child-safety lock lever 16 is in the unlocking position, the inside lever 15 rotates in a door-opening direction, so that the arm 151 engages with the child-safety lock pin 25 to carry out releasing of the outside lever 13. Thus, the door 1 can be opened.

When the child-safety lock lever 16 is in the locked position, the child-safety lock control pin 25 is held in a position in which the pin 25 is not engagable with the arm 151. Thus, even if the inside lever 15 is rotated in the door-opening direction, the rotation cannot be transmitted to the outside lever 13. So the door 1 cannot be opened.

The first fully-open-latch release lever 17 is pivotally secured to the other side of the base plate 8 with a pivot 31 and held by force of the spring 32 in the standby position in FIGS. 4, 7, 8, 13 and 14 where the lever 17 contacts a second stopper 82.

At the rear end of the first fully-open-latch release lever 17, a fifth connecting portion 172 is coupled to the upper end of a fifth cable 33 connected to the fully-open-latch device 7. At the front end, an engagement pin 171 is provided. The pin 171 extends through an arcuate hole 89 of the base plate 8 and projects from one side of the base plate 8. When the outside lever 13 is released, the pin 171 engages with outside lever 13 and moves down.

The second fully-open release lever 18 is rotatably connected to the upper part of the first fully-open-latch release lever 17. A connecting shaft 35 of the inside lever 15 slidably engages in an elongate hole 181 of the second release lever 18.

Figure 12:
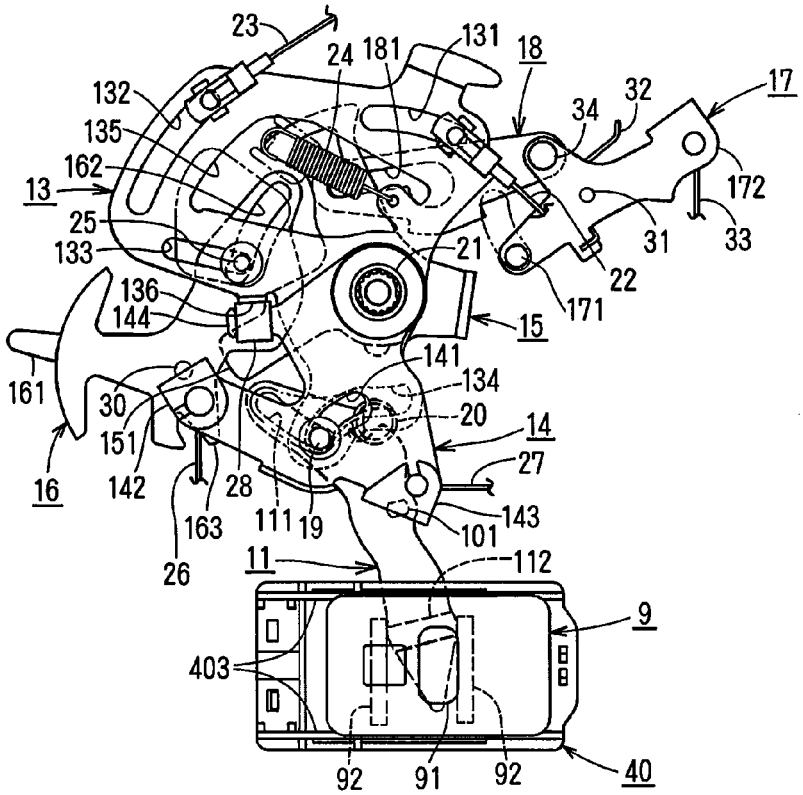
FIG. 12 is a view showing door closing when the vehicle door lock control is in the unlocking state.

When the inside lever 15 rotates from the neutral position in the door-closing direction in FIG. 12, the first fully-open-latch release lever 17 rotates from the standby position to the release position in FIGS. 9 and 10-12 via the second fully-open-latch release lever 18. The first fully-open-latch 17 rotates to the release position to make releasing of the fully-open-latch device 7 via the fifth cable 33 enabling the door 1 in the fully-open position to close. When the outside lever 13 is released, the engagement pin 171 engages with the outside lever 13 to allow the first fully-open-latch release lever 17 to turn to the release position.

Operation of the embodiment according to the present invention will be described with respect to FIGS. 7-14.

Figure 7:
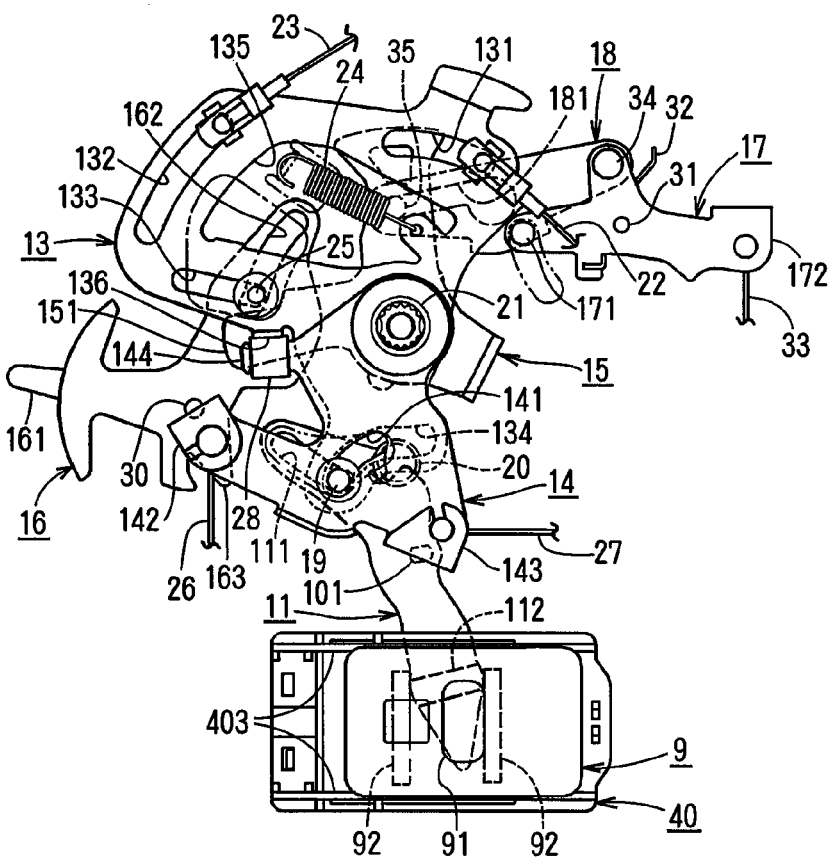
FIG. 7 is a view showing releasing operation when the vehicle door lock control according to the present invention is in an unlocking state.

(A) In FIG. 7, when the vehicle door lock control 6 is in the unlocking state and the child-safety lock lever 16 is in the unlocking state, when the outside handle 2 is opened or when the releasing actuator 12 is driven, motion is transmitted to the outside lever 13 via the first cable 22 and the second cable 23. Thus, in FIG. 9, the outside lever 13 is released thereby enabling the release lever 14 to be released via the lock control pin 19 in the unlocking position. The release lever 14 is released to enable the front door-latching device 4 and the rear door-latching device 5 to be released via the third cable 26 and the fourth cable 27 allowing the closed door 1 to open.

(B) In FIG. 7, when the inside handle 3 is operated in a door-opening direction, the inside lever 15 is rotated in a door-opening direction to allow the outside lever 13 to be released via the child-safety lock control pin 25 in the unlocking position. Thus, similar to the door-opening of the outside handle 2, the front door-latching device 4 and the rear door-latching device 5 are released to enable the closed door 1 to open.

(C) In FIG. 7, when the inside handle 3 is operated to close the door, the inside lever 15 is rotated in a door-closing direction in FIG. 12 to allow the first fully-open release lever 17 to move to the release position via the second fully-open release lever 18. Move of the first fully-open release lever 17 allows the fully-open-latch device 7 to be released via the fifth cable 33 to enable the door 1 in the fully-open position to close.

Figure 8:
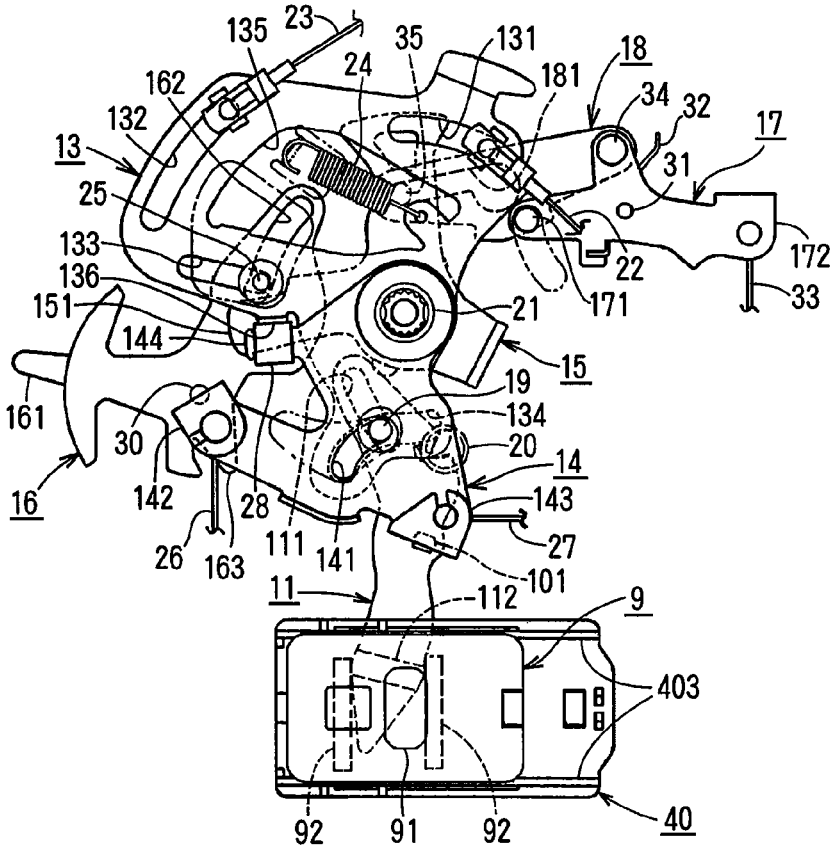
FIG. 8 is a view showing releasing operation when the vehicle door lock control is in an locked state.
Figure 9:
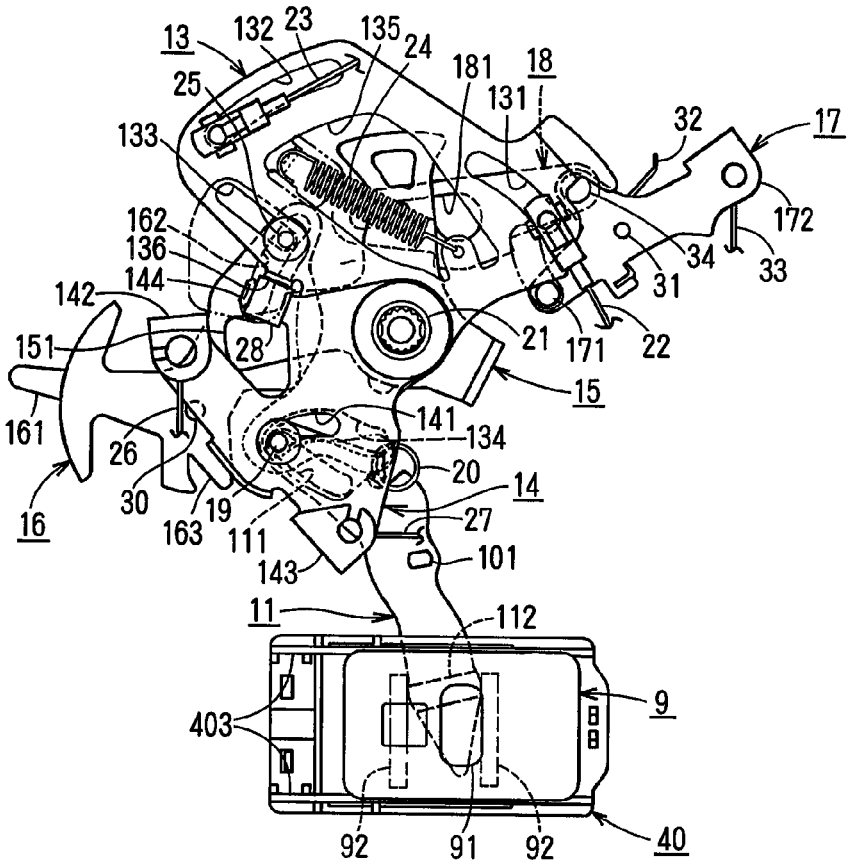
FIG. 9 is a view showing releasing operation when the vehicle door lock control is in the unlocking state.

(D) In FIG. 8, when the vehicle door lock control 6 is in the locked position and when the child-safety lock lever 16 is in unlocking position, when the outside handle 2 is operated to open the door or when the release actuator 12 is driven, motion is transmitted to the outside lever 12 via the first cable 22 or the second cable 23. However, in this case, in FIG. 10, even if the outside lever 13 is released, the release lever 14 cannot be released because the lock control pin 19 is in the locked position. Thus, the door 1 held in the closed position cannot be opened. Even if the inside handle 3 is operated to open the door, the door 1 cannot be opened as well.

Figure 13:
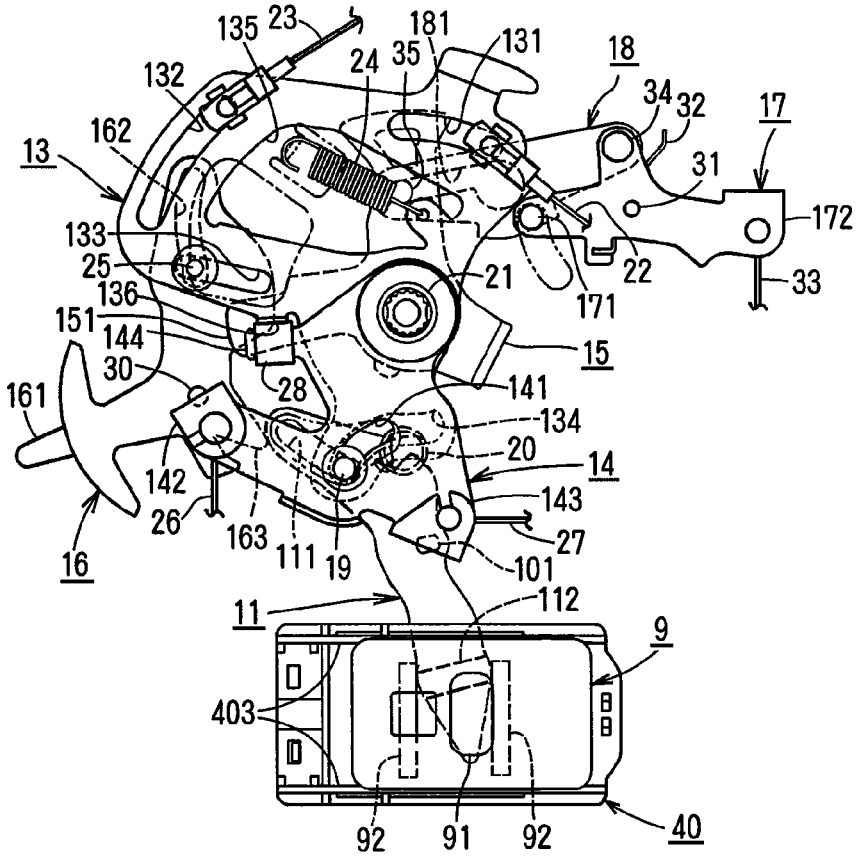
FIG. 13 is a view when the child-safety lock lever is in a locked position.
Figure 14:
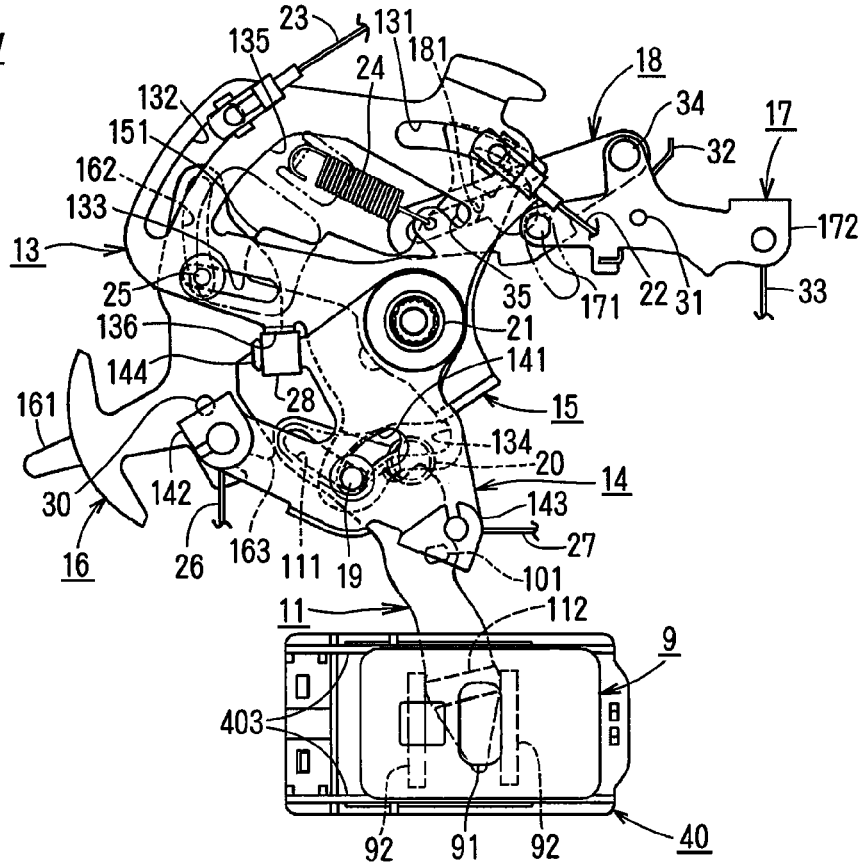
FIG. 14 is a view when the child-safety lock lever is in the locked state.

(E) In FIG. 13, when the vehicle door lock control 6 is in the unlocking position and when the child-safety lock lever 16 is in the locked position, the outside handle 2 is operated to open the door or the releasing actuator 12 is driven to enable the door 1 in the closed position to open regardless of a position of the child-safety lock lever 16 because the outside lever 13 is released.

However, if the inside handle 3 is operated to open the door, the inside lever 15 is rotated in the door-open direction not to enable the outside lever 13 to be released because the child-safety lock lever 16 is in the unlocking position to make it impossible for the arm 151 of the inside lever 15 to engage the child-safety lock pin 25. Thus, the door 1 in the closed position cannot be opened from the inside of the vehicle.

The foregoing merely relates an embodiment of the invention. Various changes and modifications may be made by a person skilled in the art without departing from the scope of claims wherein:

What is claimed is:

1. A vehicle door lock control comprising:

an operating handle fixed to a door of a vehicle;

a base plate fixed in the door and having an opening;

an operating shaft mounted to the base plate;

an operating lever pivotally secured to the operating shaft and connected to the operating handle, the operating lever having a first control hole;

a door latch device, a release lever pivotally secured to the operating shaft and a cable connecting the release lever to the door latch device, the release lever having a second control hole;

a knob provided on an interior of the vehicle;

an actuator;

an output shaft provided in the actuator;

a knob lever comprising a first end, a middle and a second end, the knob lever having an elongate hole at the first end and a protrusion at the second end, the middle of the knob lever being fixed to the output shaft of the actuator to allow the knob lever to be electrically operated by the actuator, the protrusion of the knob lever engaging with the knob; and a lock control pin that passes through and slidably engages in the elongate hole of the knob lever, the opening of the base plate, the first control hole of the operating lever and the second control hole of the release lever; the knob being moved manually to enable the knob lever to move to enable the release lever to move the lock control pin passing therethrough, thereby operating the door latch device via the cable to allow the door to open in an unlocking position and to close in a locked position.

2. A vehicle door lock control of claim 1 wherein the door comprises a slide door.

3. A vehicle door lock control of claim 1 wherein the operating handle comprises an outside handle fixed to the door outside the vehicle, the operating lever comprising an outside lever connected to the outside handle.

4. A vehicle door lock control of claim 1 wherein the knob is disposed at one side of the base plate, while the actuator is disposed at the other side of the base plate so that the knob faces the actuator at each side of the base plate.

* * * * *